US006767873B1

(12) United States Patent
Fraser

(10) Patent No.: US 6,767,873 B1
(45) Date of Patent: Jul. 27, 2004

(54) CONCENTRATED PERFUME COMPOSITIONS AND MANUFACTURE OF FABRIC SOFTENING COMPOSITIONS THEREFROM

(75) Inventor: Suart Bernard Fraser, Wirral Marseyside (GB)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/009,610

(22) PCT Filed: Apr. 20, 2000

(86) PCT No.: PCT/EP00/03724

§ 371 (c)(1),
(2), (4) Date: Apr. 15, 2002

(87) PCT Pub. No.: WO00/66703

PCT Pub. Date: Nov. 9, 2000

(30) Foreign Application Priority Data

Apr. 30, 1999 (GB) ..... 9910101

(51) Int. Cl.[7] ..... C11D 3/50
(52) U.S. Cl. ..... 510/101
(58) Field of Search ..... 510/101; 512/2, 512/3

(56) References Cited

U.S. PATENT DOCUMENTS 5,447,644 A 9/1995 Guenin et al.

FOREIGN PATENT DOCUMENTS

| | | | |
|---|---|---|---|
| DE | 19624051 A1 | * | 12/1997 |
| DE | 19751151 A1 | * | 5/1999 |
| WO | 98/08927 | | 3/1998 |
| WO | 00/06690 | | 2/2000 |

OTHER PUBLICATIONS

International Search Report PCT/EP 00 03724, dated Oct. 13, 2000—2 pp.

GB Search Report GB 9910101.6 dated Aug. 25, 1999—1 p.

* cited by examiner

*Primary Examiner*—John Hardee
(74) *Attorney, Agent, or Firm*—Ellen Plotkin

(57) ABSTRACT

The invention provides liquid compositions comprising: (a) 15–95 wt % lipophilic perfume. (b) 0.05–5 wt % water-soluble dye, (c) 4–50 wt % of a stabilising agent comprising a cationic stabilising agent, and (d) water miscible solvent wherein the composition comprises between 0.1 to 20 wt % water, the cationic stabilising agent has an Lα to Lβ transition temperature of 45° C. or less for a 5 wt % dispersion of the stabilising agent in water, and the solvent is present in an amount of up to 10 wt %. These concentrated perfume and dye compositions find particular application in fabric softening compositions. Also provided is a method of preparing a fabric conditioning composition by preparing a base composition comprising a cationic and/or nonionic fabric softening agent, and adding thereto, a composition of the invention. The fabric conditioning compositions thus produced are also provided. Simplified automated manufacture of fabric softening compositions is achieved.

12 Claims, No Drawings

CONCENTRATED PERFUME COMPOSITIONS AND MANUFACTURE OF FABRIC SOFTENING COMPOSITIONS THEREFROM

TECHNICAL FIELD

The present invention relates to concentrated perfume compositions. The invention further relates to a method of manufacturing a fabric softening composition from the concentrated perfume composition, and, to a fabric softening composition so produced.

BACKGROUND AND PRIOR ART

In the commercial manufacture of fabric softening compositions the accurate dosing of minor ingredients e.g. dyes, perfumes etc. is often problematic because of the low levels of these ingredients required in the compositions so that the relative proportions of these minor ingredients are difficult to control. Also when compositions are produced in batches this requires that the exact levels of minor ingredients, particularly dye and perfume, must be added individually which increases the possibility of inaccurate dosing.

It is also known that concentrated perfume compositions are prone to instability problems.

Thus there is a need to provide stable concentrated compositions of well-known minor ingredients such as dyes and perfumes for use in the manufacture of coloured and perfumed compositions such as fabric softening compositions.

WO 98/08927 (Colgate-Palmolive Company) discloses colour/perfume concentrate compositions comprising 0.01% to 85% by weight of a polymer bound water soluble azo dye, 99.95% to 15% by weight of a perfume and 0 to 99.99% by weight of a nonionic surfactant or an ethoxylated glycerol type compound.

WO 00/06690 (Colgate-Palmolive Company), published 10 February 2000, discloses a water-in-oil microemulsion which is capable of being mixed with an aqueous fabric softener base composition and which comprises 5 to 80% by weight of a surfactant fabric softener, a solvent, perfume and colourant.

EP 922 755 (Procter & Gamble) discloses compositions wherein alcohol ethoxylates are used to solubilise dye.

U.S. Pat. No. 5,447,644 (IFF Inc.) discloses a method of controlling the viscosity of fabric softening compositions to improve shelf life by first forming a micro-emulsion of perfume and surfactant.

The present invention seeks to address the above problems and to provide a stable concentrated composition which comprises at least two minor ingredients found in fabric softening compositions at higher levels than are typically used in a consumer product.

DEFINITION OF THE INVENTION

Accordingly the present invention provides a liquid composition comprising;

(a) 15–95 wt % lipophilic perfume, (b) 0.05–5 wt % water-soluble dye, (c) 4–50 wt % of stabilising agent comprising a cationic stabilising agent, and (d) water-miscible solvent, wherein the composition comprises between 0.1 to 20 wt % water, and the cationic stabilising agent has an L$\alpha$ to L$\beta$ transition temperature of 45° C. or below for a 5% wt dispersion of the stabilising agent in water, and the solvent is present in an amount of up to 10 wt %.

All percentages by weight herein refer to the percentage based on the total amount of the composition.

The invention also provides a method of preparing a fabric softening composition comprising the steps;

(i) preparing a base composition comprising a cationic and/or nonionic fabric softening agent, and (ii) adding to (i) a composition as defined above to produce the fabric softening composition.

Furthermore the invention also provides a fabric softening composition obtainable by the method above.

The invention provides a concentrated perfume-containing composition that also contains dye, both in a much higher concentration than would typically be found in a fabric softening composition. This provides a stable premix of minor ingredients (perfume and dye). Which can be prepared at suitable ratios for direct dosage into a base composition. Excellent accuracy of the dosage of these minor ingredients into a base composition is achieved and this thus simplifies automated preparation of fabric softening compositions.

Furthermore the concentrated perfume and dye compositions allow accurate dosing of these minor ingredients to a base composition at a late stage (eg. after the main active ingredients have been mixed) of the manufacture of a fabric softening composition. This in turn allows a wide range of compositions to be prepared from a pre-compounded base composition, so providing easier and more versatile manufacture. Thus changing between variant formulations is simplified as only a small part of the automated production apparatus requires cleaning when the 'minors' are changed in the composition (as a single 'minor' composition can be used in the process). This provides reduced aqueous effluent, saves production time and provides increased production flexibility.

In particular, the invention provides the preparation of a concentrated composition of perfume and dye, wherein the perfume and dye are of different lipophilic and lipophobic characters.

DETAILED DESCRIPTION OF THE INVENTION

The composition of the invention is preferably an isotropic liquid, most preferably a microemulsion, and especially a water-in-oil microemulsion.

It is preferred that if the composition is an isotropic liquid it does not contain liquid crystalline phases.

Where the compositions are not clear, they should be stable to storage at 20° C. for several days eg. 2 days. Whilst some degree of cloudiness can be tolerated in the compositions, it is preferred that they are isotropic liquids. Such isotropic liquids may have included therein minor amounts of materials that are not isotropic, provided, the stability of the composition is not adversely affected.

Perfume

The perfume used in the invention is lipophilic in nature. By a lipophilic perfume is meant that the perfume has a solubility in water (i.e. it dissolves) of 1 g or less in 100 ml of water at 20° C. Preferably the solubility in water is equal to or less than 0.5 g, preferably equal to or less than 0.3 g in 100 ml of water at 20° C. Such perfumes may be referred to as water-insoluble perfumes.

The perfume may be any conventional perfume used in fabric softening compositions. The perfume will thus preferably be compatible with the fabric softening actives typically found in fabric softening compositions, although, not many commercially available perfumes will not be compatible. Also the perfume will generally be polar in nature.

When the composition is a water-in-oil microemulsion the perfume will, because of its lipophilic nature, form the predominant part of the oil phase. It is preferred if the perfume comprises 60% by weight or more, preferably 70% by weight or more, of the oil phase when the composition is a water-in-oil microemulsion.

Perfumes contain a number of ingredients which may be natural products or extracts such as essential oils, absolutes, resinoids, resins etc. and synthetic perfume components such as hydrocarbons, alcohols, aldehydes, ketones ethers, acids, esters, acetals, ketals, nitrites, phenols, etc. including saturated and unsaturated compounds, aliphatic, alicyclic, heterocyclic and aromatic compounds. Examples of such perfume components are to be found in "Perfume and Flavour Chemicals" by Steffen Arctander (Library of Congress catalogue card no. 75-91398).

Any lipophilic perfume which is compatible with nonionic and/or cationic compounds may be used in the composition.

The compositions contain 15–95 wt % of lipophilic perfume, preferably 20–90 wt %, more preferably 25–85 wt %, such as 40–85 wt %, e.g. 45–80 wt %.

More than one lipophilic perfume may be used in the compositions of the invention.

Dye

The dye is an at least a sparingly water-soluble dye and may be any such dye conventionally used in softening and cleaning products. It is especially preferred that the dye has a solubility in water of equal to, or greater than, 2 g in 100 ml of water at 20° C., preferably equal to or greater than 5 g.

The dye may be an acid-dye or other suitable type of dye. For an acid dye, the solubility may be as high as 50 g in 100 ml of water of 20° C.

The dye is present in an amount of 0.05–5 wt %, preferably 0.1–2 wt %, more preferably 0.2–1 wt %, eg 0.25–0.7 wt %.

The weight ratio of perfume to dye is preferably within the range 200:1 to 5:1, more preferably 150:1 to 10:1, e.g. 100:1 to 15:1, such as 80:1 to 20:1. Depending upon the amount of dye required, the ratio could be towards the lower end of the ratio e.g. 40:1 to 25:1. However if only a small amount of dye is required the ratio may be higher e.g. 900:1 to 200:1, eg. 900:1 to 250:1.

Stabilising Agent

The stabilising agent comprises a cationic stabilising agent having an Lα to Lβ transition temperature of 45° C. or below for a 5 wt % dispersion of the stabilising agent in water. This Lα to Lβ transition can be measured by DSC as defined in "Handbook of Lipid Bilayers", D Marsh, CRC Press, Boca Raton, Fla., 1990 (pages 137 and 337).

Any cationic stabilising agent meeting the above transition temperature requirement, may be used according to the invention. Compounds falling within definitions of formulae (i) are (ii) below and meeting the transition temperature requirements are cationic stabilising agents according to the invention. Compounds falling within the definitions (i) and (ii) but which do meet the transition temperature requirements are not cationic stabilising agents as herein defined.

The cationic stabilising agent used in the invention is preferably a cationic surfactant, more preferably one of the quaternary ammonium compounds of formulae (A), (i) or (ii) below. Compounds of these formulae are only stabilising agents as referred to herein if they meet the above transition temperature requirement.

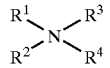

(A)

wherein $R^1$ and $R^2$ are independently $C_1$–$C_6$ alkyl, alkenyl, substituted alkyl or alkenyl groups, or hydroxyalkyl groups and $R^3$ and $R^4$ are independently $C_8$–$C_{28}$ alkyl, alkenyl, substituted alkyl or alkenyl groups, or hydroxalkyl groups. Preferably $R^1$ and $R^2$ are independently $C_1$–$C_2$ groups and $R^3$ and $R^4$ are independently $Cl_2$–$C_{22}$ groups, $X^-$ is a compatible anion eg $Cl^-$, $MESO_4^-$, $Br^-$, $I^-$ acetate etc.

A cationic surfactant stabiliser according to formula (A) is ditallowyl dimethyl ammonium chloride.

The cationic stabiliser may also be a compound as defined by formulae (i) and (ii) below, provided, that compound meets the transition temperature requirements therein defined.

A cationic stabiliser according to formula (i) below is dioleyl ester of methyl triethanol ammonium methosulphate wherein one $R^1$ is methyl and one is hydroxyethyl, both n are 2, both T are O—C═O, and both $R^2$ are tallow.

It is preferred that the stabilising agent is compatible with conventional fabric softening agents, and in particular with the fabric softening agents described herein. Mixtures of cationic stabilising agents may also be included. In many cases the cationic stabilising agent and the fabric softening agent will be the same compound.

Optional Stabilising Agent

Nonionic stabilising agents may be used in addition to the cationic stabilising agent. Preferably the nonionic stabilising agent is a nonionic surfactant. Suitable types of nonionic surfactants include alcohol alkoxylates especially ethoxylates, preferably $C_8$–$C_{20}$ alkyl esters alkoxylated with an average of 1 to 10 alkoxylate units, preferably 1 to 7 alkoxylate units. The ethoxylates, especially secondary alcohol ethoxylates, are particularly preferred.

The total amount of stabilising agent (cationic or cationic plus nonionic)in the compositions is 4 wt %–50 wt %, preferably 10–30 wt %, more preferably 15–25 wt %. Where a mixture of cationic and nonionic stabilisers are used, the weight ratio of cationic:nonionic is preferably in the range 99:1 to 50:50, more preferably 99:1 to 60:40.

It is especially preferred that 10 wt %–30 wt % cationic surfactant is used as the stabilising agent, plus optionally an additional amount of nonionic stabilising agent.

The weight ratio of perfume to the total amount of stabilising agent is preferably within the range 10:1 to 1:1, more preferably 8:1 to 1:1, e.g. 5:1 to 1:1, e.g. 3:1 to 1:1.

Water-miscible Solvent

The compositions comprise water-miscible solvents in amounts of up to 10 wt % of the composition, preferably up to 7.5 wt % as an essential element of the invention. The solvent is preferably present in an amount of 0.1–10 wt %, more preferably 0.5 to 7.5 wt %.

The water-miscible solvent may be solvent having a $C_1$–$C_6$ alkyl chain such as ethanol or isopropanol. The solvent may be present in the compositions either through direct addition or it may be added by being present in the stabilising agent or other component of the composition.

The compositions may also include low amounts (up to 5% by weight) of 'minor' ingredients (other than dye or perfume) typically found in fabric softening compositions, provided, the stability of the composition is not affected. 'Minor' ingredients that may be included include fatty acids, non-aqueous solvents, fluorescers, hydrotropes, antifoaming agents, anti-redeposition agents, enzymes, optical brightening agents, opacifiers, anti-shrinking agents, anti-wrinkle agents, anti-spotting agents, germicides, fungicides, anti-oxidants, UV absorbers (sunscreens), sequestrants, preservative, chlorine scavengers, pH buffering agents, dye fixatives, anti-corrosion agents, drape imparting agents, and antistatic agents.

The compositions comprise 0.1–20 wt % water, preferably 0.1–15 wt %, more preferably 0.1–10 wt %.

Any suitable method of preparing the compositions of the invention may be used. For example the perfume, stabilising agent and any other oil soluble ingredients are mixed together to form a clear liquid. Gentle heating and/or stirring may be necessary at this point to produce the clear liquid (typically heating at 25–45° C.). Water-soluble ingredients including the dye (and other 'minor' ingredients such as preservative) are dissolved separately in the required amount of water. The water-soluble aqueous portion is added to the perfume containing mixture, in aliquots if required, with stirring to produce the composition.

A further aspect of the present invention provides a method of producing a fabric softening composition by adding a composition of the invention to a base composition comprising a cationic and/or nonionic fabric softening agent. Preferably the base composition is aqueous. The addition may be made in any suitable manner.

The composition is added at a suitable % by weight to give the required amount of perfume and dye etc. in the resultant fabric softening composition. The addition amount, and effectiveness of mixing, can be easily checked by measuring the colour. The fabric softener composition produced by the above method contains cationic and/or nonionic fabric softening agents.

Types of cationic fabric softeners that may be used in the fabric softening compositions produced from the compositions of the invention include substantially water-insoluble quaternary ammonium materials, for example, a compound having two $C_{12}$–$C_{22}$ alkyl or alkenyl groups connected to a quaternary ammonium head group or a compound comprising a single long chain with an average chain length equal to or greater than $C_{20}$. Preferably these are connected to the quaternary ammonium head group via at least one ester link.

More preferably, the invention is useful for preparing compositions comprising quaternary ammonium material comprising a compound having two long chain alkyl or alkenyl chains with an average chain length equal to or greater than $C_{14}$. Even more preferably, each chain has an average chain length equal to or greater than $C_{16}$. Most preferably at least 50% of each long chain alkyl or alkenyl group has a chain length of $C_{18}$.

It is preferred if the long chain alkyl or alkenyl groups are predominantly linear. The especially preferred ester-linked quaternary ammonium materials for use in the invention can be represented by the formula (i):

(i)

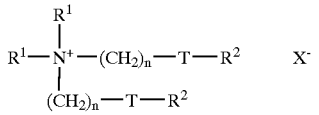

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; $X^-$ is any suitable counterion, for instance a halide, acetate or lower alkosulphate ion, such as chloride or methosulphate, T is 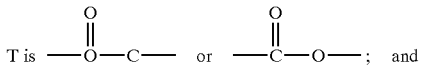 ; and n is an integer from 0–5

Di(tallowyloxyethyl)dimethyl ammonium chloride, available from Clariant, is especially preferred, also Di (hardened tallowyloxyethyl)dimethyl ammonium chloride, ex Clariant). Dioleyl ester of methyl triethanol ammonium methosulphate wherein one $R^1$ is methyl and one is hydroxyethyl, both n are 2, both T are O—C═O, and both $R^2$ are tallow may also be used.

A second preferred type of quaternary ammonium material can be represented by the formula (ii):

(ii)

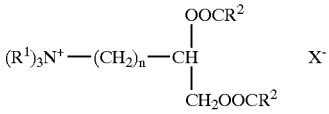

wherein $R^1$, n, $R^2$ and $X^-$ are as defined above.

It is advantageous for environmental reasons if the quaternary ammonium material is biologically degradable.

Preferred materials of this class such as 1,2 bis[hardened tallowoyloxy]-3-trimethyl ammonium propane chloride and their method of preparation are, for example, described in U.S. Pat. No. 4,137,180 (Lever Brothers). Preferably these materials comprise small amounts of the corresponding monoester as described in U.S. Pat. No. 4,137,180 for example 1-hardened tallowoyloxy-2-hydroxy-3-trimethylammonium propane chloride.

The fabric softeners used in the compositions produced from the compositions of the invention are not required to meet the Lα to Lβ transition temperature referred to above. Only the cationic stabilisers, which may be of formulae (i) or (ii) above, are required to have the specified transition temperature. If compounds of these formulae are used only as a fabric softening active material, the transition temperature requirement does not apply.

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

The fabric softening compositions typically contain 1–8 wt % of the fabric softening compound, and are known as dilute compositions. They may also contain higher amounts, such as 8–50% softening compounds in which case they are known as concentrates.

Nonionic fabric softeners may also be used, for example sorbitan esters and glycerol monostearate.

Further ingredients, typically minor ingredients, may be added to the fabric softener compositions produced by the method described herein.

The present invention will be exemplified by way of the following examples. Further examples within the scope of the invention will be apparent to the skilled person. The reference to grams of active ingredient in each example refers to the weight of each ingredient as supplied by the manufacturer used in the example.

EXAMPLE 1

Concentrated Perfume Composition

The composition below was prepared by mixing the perfume and Tetranyl AO-1 to form a clear liquid. Gentle warming was used. The dye and water were mixed to form a solution and this was added in aliquots to the perfume mixture to produce the composition.

| | grams of active ingredient |
|---|---|
| Perfume*[1] | 34.2 |
| TETRANYL AO-1*[2] | 10.0 |
| Patent blue dye (10% aqueous solution by weight) | 2.0 |

*[1]SOFTLINE 2000 (ex Givaudan Roure; SOFTLINE IS A TRADEMARK)
*[2]TETRANYL AO-1 is 90% dioleyl ester of methyl triethanol ammonium methosulphate, 10% IPA (Ex Kao). TETRANYL is a trademark.

EXAMPLE 2

Concentrated Perfume Composition

The composition below was prepared according to the method of example 1.

| | grams of active ingredient |
|---|---|
| Perfume*[3] | 34.2 |
| AO-1*[2] | 10.0 |
| Patent blue dye (5% aqueous solution by weight) | 2.0 |

*[3]SOFTLINE B53 ex Givaudan Roure

EXAMPLE 3

Concentrated Perfume Composition

The composition below was prepared according to the method of example 1.

| | grams of active ingredient |
|---|---|
| Perfume*[1] | 34.2 |
| PRAPAGEN 3445*[4] | 10.0 |
| Patent blue dye (10% aqueous solution by weight) | 2.0 |

*[4]PRAPAGEN 3445 is 70% ditallowyl dimethyl quaternary ammonium chloride, 20% IPA and 10% water (ex Clariant). PRAPAGEN is a trademark.

EXAMPLE 4

Concentrated Perfume Composition

The composition below was prepared according to the method of example 1.

| | grams of active ingredient |
|---|---|
| Perfume*[5] | 34.2 |
| ARQUAD 2T*[6] (as supplied) | 12.2 |
| RHODAMINE B dye (5% aqueous solution by weight) | 2.0 |

*[6]cationic surfactant ditallowyl dimethyl quaternary ammonium chloride (ex Akzo). ARQUAD is a trademark.
*[5]HORIZON 2000 ex IFF. HORIZON is a trademark. RHODAMINE is a trademark.

EXAMPLE 5

Concentrated Perfume Composition

The composition below was prepared according to the method of example 1.

| | grams of active ingredient |
|---|---|
| Perfume*[5] | 34.2 |
| AO-1*[2] | 10.0 |
| Patent blue dye (10% aqueous solution by weight) | 2.0 |

EXAMPLE 6

Concentrated Perfume Composition

The composition below was prepared according to the method of example 1.

| | grams of active ingredient |
|---|---|
| Perfume*[3] | 35.0 |
| GENAPOL Coco 10*[7] | 3.0 |
| AOT-1*[8] | 4.6 |
| Patent blue dye (5% aqueous solution by weight) | 2.0 |

*[7]Genapol C-10 is coconut ethoxlated alcohol with an average of 10 moles of ethoxylate per mole of fatty alcohol (ex Clariant). GENAPOL is a trademark.
*[8]TETRANYL AOT-1 is 80% dioleyl ester of methyl triethanol ammonium methosulphate, 20% dipropylene glycol solvent Examples 1 to 6 were all stable, isotropic water-in-oil microemulsions.

EXAMPLES 7

Use of Example 1 to Prepare a Fabric Softening Composition

A fabric softening base composition comprising 94.5 parts water and 5 parts dihardened tallow dimethyl ammonium chloride was prepared. To this 0.5 parts of example 1 was added and the composition stirred until homogeneous (to provide approximately 0.37% perfume, 0.11% AO-1 and 0.002% dye). A stable fabric softening composition was produced that showed the same physical characteristics as the comparative example below.

A comparative example was produced by the conventional method of mixing together the following ingredients:

| | grams of active ingredient |
|---|---|
| Dihardened tallow dimethyl ammonium chloride | 5.0 |
| Perfume*1 | 0.3 |
| Patent blue dye | 0.002 |
| Water | to 100% |

The fabric softening composition comparative example and the fabric softening composition produced from example 1 both exhibited good stability on storage at room temperature.

EXAMPLE 8

A concentrated fabric conditioner was prepared from 1,2 bis[hardened tallowoyloxy]-3-trimethyl ammonium propane chloride following standard procedures but without perfume or dye. Subsequently the perfume dye mixture of example 2 was added to this composition with gentle stirring. The Table below shows product viscosity, measured at $106S^{-1}$, as a measure of stability compared with a control product of identical composition but with perfume and dye added separately during the conditioner preparation.

| | 24 hours old | 2 weeks | 4 weeks |
|---|---|---|---|
| 4° C. | | | |
| Prototype | 113 | 98 | 88 |
| Control | 114 | 111 | 101 |
| Ambient | | | |
| Prototype | 113 | 103 | 86 |
| Control | 114 | 112 | 96 |
| 37° C. | | | |
| Prototype | 113 | 101 | 84 |
| control | 114 | 107 | 90 |

What is claimed is:

1. A liquid composition comprising:

(a) 15–95 wt % lipophilic perfume, (b) 0.05–5 wt % water-soluble dye, (c) about 10 wt % to about 30 wt % of a stabilising agent comprising a cationic stabilising agent that is a compound of general formula (A)

(A)

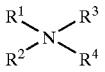

wherein $R^1$ and $R^2$ are independently $C_1$–$C_6$ alkyl, alkenyl, substituted alkyl or alkenyl groups, or hydroxyalkyl groups; and $R^3$ and $R^4$ are independently $C_8$–$C_{28}$ alkyl, alkenyl, substituted alkyl or alkenyl groups, or hydroxyalkyl groups or, a compound of general formula (i)

(i)

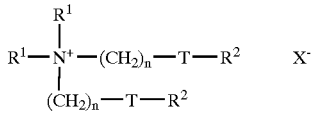

wherein each $R^1$ group is independently selected from $C_{1-4}$ alkyl, hydroxyalkyl or $C_{2-4}$ alkyl groups; and wherein each $R^2$ group is independently selected from $C_{8-28}$ alkyl or alkenyl groups; $X^-$ is chloride or methosulphate;

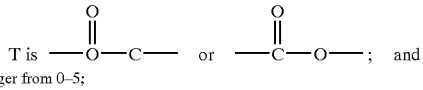

n is an integer from 0–5;

or, a compound of general formula (ii)

(ii)

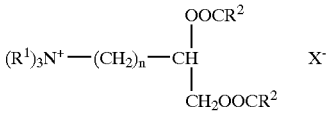

wherein $R^1$, n, $R^2$ and $X^-$ are as defined above; and (d) water miscible solvent;

wherein the composition comprises between 0.1 to 20 wt % water, the cationic stabilising agent has an Lα to Lβ transition temperature of 45° C. or below for a 5 wt % dispersion of the stabilising agent in water and the solvent is present in an amount of up to 10 wt %.

2. A composition according to claim 1 wherein the composition is an isotropic liquid.

3. A composition according to claim 2 wherein the isotropic liquid is a water-in-oil microemulsion.

4. A composition according to claim 1 comprising 40–85 wt % perfume.

5. A composition according to claim 1 wherein the perfume has a solubility in water of equal to, or less than 0.5 g in 100 ml of water at 20° C.

6. A composition according to claim 1 comprising 0.2 wt % to 1 wt % dye.

7. A composition according to claim 1 wherein the dye has a solubility in water of equal to or greater than 5 g of 100 ml of water at 20° C.

8. A composition according to claim 1 wherein the weight ratio of perfume to dye is within the range 200:1 to 5:1, preferably 100:1 to 15:1.

9. A composition according to claim 1 wherein the weight ratio of perfume to stabilising agent is 10:1 to 1:1, preferably 5:1 to 1:1.

10. A composition according to claim 1 comprising 0.1–10 wt % water.

11. A method of preparing a fabric softening composition comprising the steps;

(i) preparing a base composition comprising a cationic and/or nonionic fabric softening agent, and (ii) adding to (i) a composition according to claim 1, to produce the fabric softening composition.

12. A fabric softening composition obtainable by the method of claim 11.

* * * * *